United States Patent [19]

Anzai

[11] Patent Number: 4,772,297

[45] Date of Patent: Sep. 20, 1988

[54] AIR CLEANER

[75] Inventor: Kiyoshi Anzai, Hiratsuka, Japan

[73] Assignee: Kyowa Seiko Co., Ltd., Hiratsuka, Japan

[21] Appl. No.: 897,835

[22] Filed: Aug. 19, 1986

[30] Foreign Application Priority Data

Sep. 20, 1985 [JP] Japan ..... 60-144993[U]

[51] Int. Cl.[4] ..... B03C 3/08; B03C 3/36; B03C 3/14

[52] U.S. Cl. ..... 55/106; 55/126; 55/130; 55/137; 55/143; 55/145; 55/155

[58] Field of Search ..... 55/124, 126, 130, 137, 55/141, 142, 143, 145, 146, 155, 104, 136, 106

[56] References Cited

U.S. PATENT DOCUMENTS

| | | | |
|---|---|---|---|
| 1,132,124 | 3/1915 | Schmidt et al. | 55/130 |
| 2,813,595 | 11/1957 | Fields | 55/137 |
| 2,990,911 | 7/1961 | Lippincott | 55/104 |
| 3,073,094 | 1/1963 | Landgraf et al. | 55/131 |
| 3,665,679 | 5/1972 | McLain et al. | 55/137 |
| 3,740,926 | 6/1973 | Duval | 55/104 |
| 3,804,942 | 4/1974 | Kato et al. | 55/6 X |
| 4,007,024 | 2/1977 | Sallee et al. | 55/126 |
| 4,026,684 | 5/1977 | Finger | 55/126 |
| 4,124,359 | 11/1978 | Geller | 55/130 |
| 4,166,729 | 9/1979 | Thompson et al. | 55/143 X |
| 4,253,852 | 3/1981 | Adams | 55/126 |
| 4,259,093 | 3/1981 | Vlastos et al. | 55/137 |
| 4,516,991 | 5/1985 | Kawashima | 55/137 X |
| 4,602,921 | 7/1986 | Shinohara et al. | 55/126 |

FOREIGN PATENT DOCUMENTS

| | | | |
|---|---|---|---|
| 2427759 | 1/1976 | Fed. Rep. of Germany | 55/142 |
| 931625 | 7/1963 | United Kingdom | 55/124 |

*Primary Examiner*—Kathleen J. Prunner
*Attorney, Agent, or Firm*—Fisher, Christen & Sabol

[57] ABSTRACT

An air cleaner comprising arranging minus and plus electrodes in such a manner that they have a certain space between them, applying high voltage of about 3 KV-7 KV to them, and letting air pass through this high voltage region to charge and absorb dust and other substances in the air, wherein a dust collector comprises a frame completely or half independent of the air cleaner body, a plus electrode arranged inside the frame, a detachable minus electrode enclosing the plus electrode, these plus and minus electrodes forming an electrode section, and a detachable filter unit positioned near an outlet side of the electrode section, and wherein another minus electrode is also provided at a filter section.

11 Claims, 3 Drawing Sheets

AIR CLEANER

BACKGROUND OF THE INVENTION

The present invention relates to an air cleaner which is a kind of electrostatic precipitator and which is used to eliminate floating fine dust and smelling substances in the air at homes, shops, offices, hospitals, and the like. More particularly, it relates to an air cleaner high in the effect of absorbing floating dust and other substances, easy to maintain, and having an improved electrode and filter arrangement to keep its high absorbing effect.

The industrial electrostatic precipitator machine which is intended to pass gaseous waste containing smelling toxic gas, dust and other substances through a high voltage region, charge the floating dust and other substances by corona discharge, and absorb and separate the charged dust and other substances from the waste was successfully practiced by F. G. Cottrell at the beginning of 20th century. Since then, it has become popular as being essential to factory facilities to prevent public pollution. In order to enhance the dust collecting efficiency, some improvements have added to it in the form of the wet or dry system. Further, various improvements have also added to it relating to its construction, but its fundamental theory is not changed.

As spiritual and physical healths attract attention more and more these days, cleanness is asked under life circumstances at home as well as labor circumstances and various home-use air cleaners have been brought to market to meet this demand.

These air cleaners use the principle of the above-described electrostatic precipitator machine and most of them are small-sized and made low on cost. When they are checked on their dust collecting efficiency and capacity, therefore, some of them cannot be deemed as practically effective, and particularly almost all of them pay no attention to their maintenance.

In the case of the air cleaner which uses the principle of the electrostatic dust collector machine, dust and other substances in the air can be eliminated in such a way that the charged dust and other substances are absorbed onto the minus electrode. As the absorption of dust and other substances advances, the surface of the minus electrode becomes as if it were covered by soot, thereby lowering the dust absorbing efficiency remarkably. Therefore, the charged particles are not absorbed but scattered to contaminate the surroundings by the soot-like dust. In addition, they hurt the eyes of persons around.

It was practically impossible for users to clean the minus electrode in the case of the conventional air cleaner. Further, maintenance including the exchange of filter was very complicated.

SUMMARY OF THE INVENTION

Studying the air cleaner for many years, the inventor of the present invention proposed by his Japanese Patent Publication No. (58-17379) an air cleaner whose dust collecting efficiency was remarkably enhanced. As the result of his having advanced his study about the air cleaner, he has reached the present invention by which there is provided an air cleaner comprising arranging plus and minus electrodes in such a way that they have a certain interval between them, applying high voltage of about 3 KV–7 KV to them, and letting air through this high voltage region to charge and absorb dust and other substances in the air, characterized in that a frame completely or half independent of the air cleaner body is prepared with a plus electrode housed inside and a detachable minus electrode enclosing the plus electrode, these plus and minus electrodes forming an electrode section, and a detachable filter unit is positioned near an outlet side of the electrode section, that the minus electrode is formed by metal such as aluminum, or by making its substrate of synthetic resin and aluminium-evaporating the surface of the substrate to make it conductive, or conductive synthetic resin, and that another minus electrode is arranged at the filter unit.

The first object of the present invention is therefore to provide an air cleaner most suitable for use in homes, offices, shops, hospitals and the like.

The second object of the present invention is to provide an air cleaner easy to maintain and capable of keeping its high absorption efficiency for a long time.

The third object of the present invention is to provide an air cleaner whose dust absorbing efficiency is enhanced at the filter unit.

The fourth object of the present invention is to provide an air cleaner whose filter can be easily exchanged.

These and other objects as well as merits of the present invention will become apparent from the following description with reference to the accompanying drawings.

DETAILED DESCRIPTION OF THE PREFERRED EMBODIMENT

Figure 1:
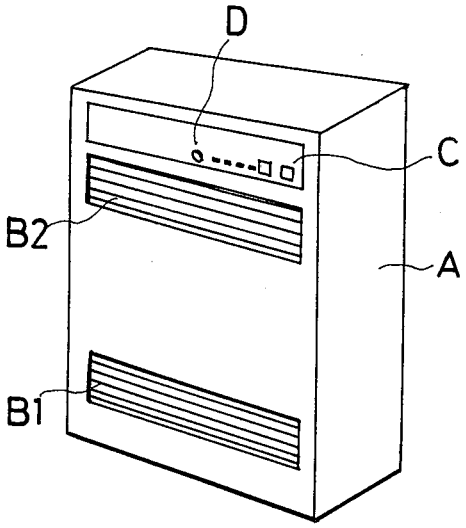
FIG. 1 is a perspective view showing an example of the air cleaner according to the present invention.
Figure 2:
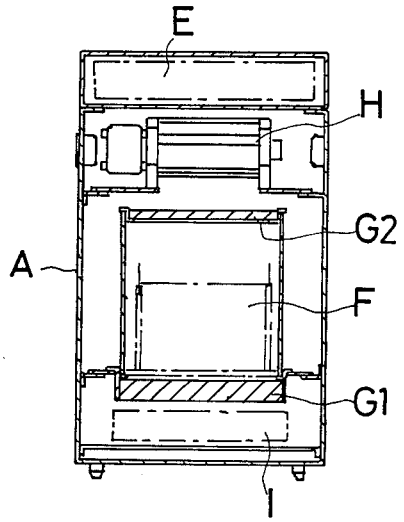
FIG. 2 is a sectional front view.
Figure 3:
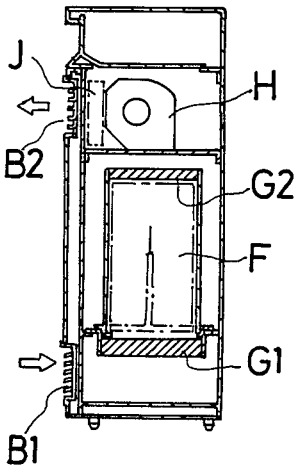
FIG. 3 is a sectional side view.

In FIGS. 1 through 3, symbol A represents a cabinet provided with an air inlet B1, an air outlet B2, an operation section C and a sensor section D. Inside the cabinet A are housed a circuit section E, a dust collector section F, filter sections G1, G2 and a ventilator section H. Depending upon the weather condition at the place where the air cleaner is installed, it may be arranged that a humidity removing section I is provided at a space under the filter section G1 while a humidity adding section J is provided behind the ventilator section H, in addition to a section for generating and supplying ozones and minus ions.

Although deodorant made of Zeolite has been incorporated into the filter section G2 in the case of the air cleaner shown, it may be independent of the filter sections G1 and G2.

In the circuit section E, commercial alternating current is rectified to direct current and pulse current of about 3 KV–7 KV is generated, turning on and off about 180 times per second. When air is passed through the air cleaner by a ventilator such as sirocco fan at the ventilator section H, entering into the air inlet B1 and coming out of the air outlet B2, while applying the pulse current between the plus and minus electrodes at the dust collector section F, large particles of dust can be removed by a pre-filter at the filter section G1 and remaining particles of dust and others in the air are charged to plus due to corona discharge radiated from the plus electrode to the minus electrode and then absorbed onto the minus electrode. Further particles of dust and others in the air which have been passed without being absorbed onto the minus electrode are absorbed by a filter and another minus electrode at the filter section G2.

A sensor for detecting tobacco smoke, alcohol and the like is provided at the sensor section D and when it is detected that air in the room becomes unclean, the air cleaner is automatically rendered operative.

In order to absorb and remove those bad smell and toxic components which cannot be removed by the fiber-like filters of the commercial type at the dust collector and filter sections F and G2, the deodorant made of Zeolite and an active carbon filter which will be described later may be used at the filter section G2 or independently of the filter section G2.

A limit switch is provided to automatically turn off the electric line when the front cover of the cabinet is opened. In addition, the dust collector section F, filter sections G1 and G2 are formed as a unit and both of the collector section and the filter sections or only the minus electrode and filters can be detached from a frame 10, thereby enabling the dirty or unclean minus electrode and filters to be cleaned or exchanged with new ones.

The dust collector section F and filter sections G1 and G2 which are main components in the air cleaner of the present invention will be described in detail with reference to FIGS. 5 through 10.

Figure 5:
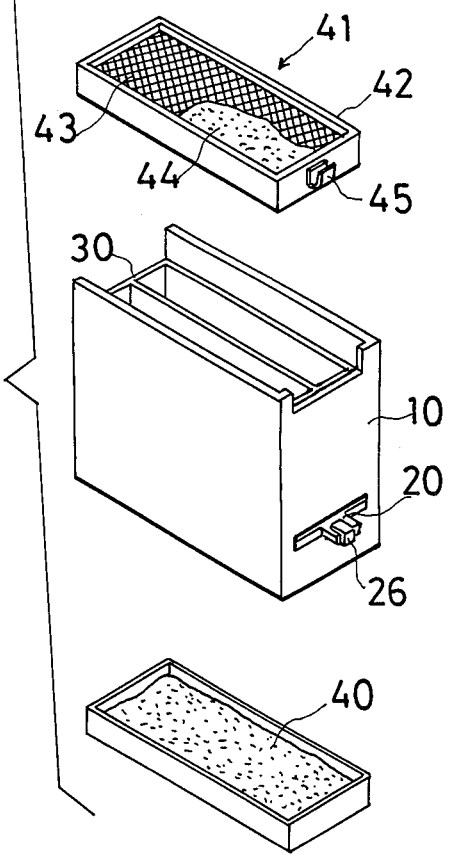
FIGS. 5 through 10 are isometric views showing a dust collecting unit dismantled.
Figure 6:
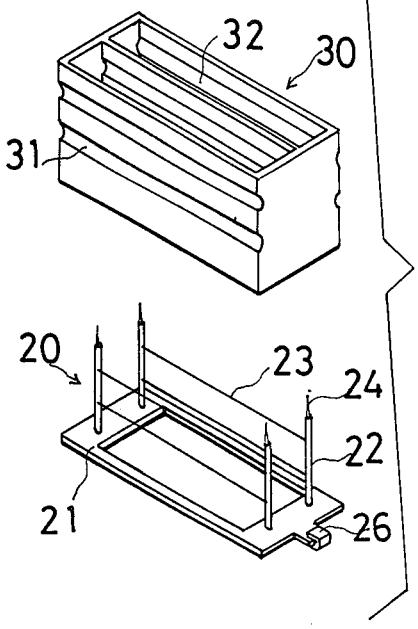

FIGS. 5 and 6 are isometric views showing a dust collector unit dismantled, wherein the dust collector section F and filter sections G1, G2 are formed as a unit.

Figure 4:
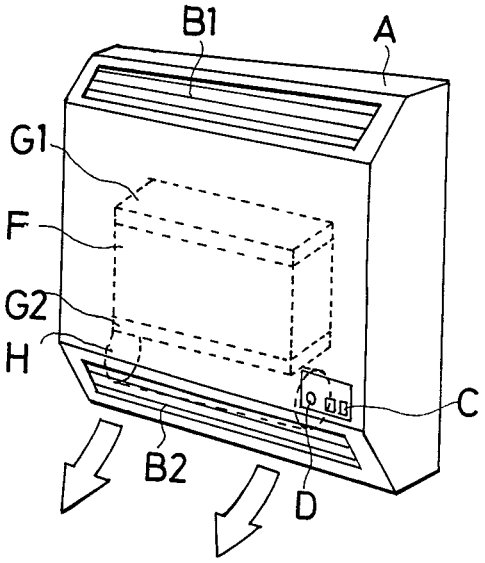
FIG. 4 is a perspective view showing another example of the air cleaner according to the present invention.

In the Figures, numeral 10 denotes the frame made of non-conductive material such as synthetic resin. Numeral 20 represents a plus electrode unit, 30 a minus electrode unit, and 40, 41 filter units, whose filter unit denoted by 40 serves as a pre-filter. In the case of the air cleaner shown in FIG. 4, the filters 40 and 41 are reversed in their position.

As shown in FIG. 6, the plus electrode unit 20 comprises a base plate 21, support rods 22 erected on the base plate 21, electrodes 23 each being a chrome-plated tungsten line having a diameter of preferably about 0.3 mm and stretched between two support rods 22, and plus electrodes 24 each projecting from the foremost end of the support rod 22 to generate ozones, if necessary. Numeral 26 denotes a terminal extending from the electrodes 23 and 24 and this terminal is connected to a terminal (not shown) located on the side of the power source.

As shown in FIG. 5, the plus electrode unit 20 is freely detachably arranged inside the frame 10 in the center thereof.

As shown in FIG. 6, the minus electrode unit 30 is a frame opened at the top and bottom thereof and this frame is made by molding synthetic resin and evaporating a film of metal onto the surface of thus-molded frame, or it is made by aluminum net or stamped metal net.

More preferably, the minus electrode unit 30 is made cheap by injection-molding synthetic resin and it is exchanged with a new one if necessary from the viewpoint of maintenance. Conductive synthetic resin may be used in this case.

Numerals 31 and 32 represent concaved and convexed portions which are intended to change the flow of air.

Figure 7:
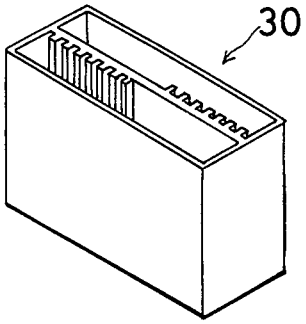

FIGS. 7 through 10 show other examples of the minus electrode. The unit shown in FIG. 7 is injection-molded, having a corrugated center partition wall. When this unit is cut to pieces having an appropriate height, as shown in FIG. 7, and they are put one upon the other with their front side back alternately, they can serve as a collision plate for changing the flow of air.

Figure 8:
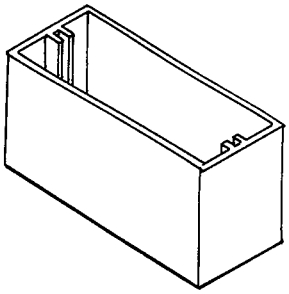
Figure 9:
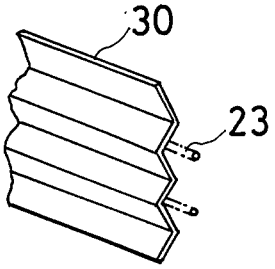

When it is difficult to mold the member which has concaved and convexed portions, only the frame is injection-molded, as shown in FIG. 8, and a minus electrode made of metal and being bent along the flow direction of air, as shown in FIG. 9 is attached to the injection-molded frame. Single or plural plus electrodes may be arranged horizontal in this case.

Figure 10:
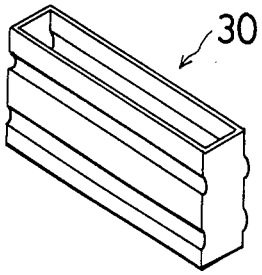

FIG. 10 shows a further example of the minus electrode wherein a frame is blow-molded and metal evaporation is applied to the surface of the blow-molded frame and wherein plural units of thus-formed frames are combined with one another to form the minus electrode.

The filter units 40 and 41 will be described next. The filter unit 41 which is used as the filter section G2 under the dust collector section F comprises a frame 42 opened at the top and bottom thereof, a filter 44 formed by 'Filteret' made by Sumitomo 3M Corporation, for example, and arranged inside the frame 42, and nets 43 made of preferably aluminum and placed on and under the filter 44 to sandwich the filter 44. Two or more nets 43 and filters 44 may be laminated one upon the other.

Although the net-like one shown can be used as the minus electrode attached to the filter 41, a fiber-like one made of metal such as aluminum may be mixed in a fiber-like filter or plural fiber-like ones may be laminated with the fiber-like filters.

The pre-filter 40 may have no net portion which serves as the minus electrode.

Deodorant, aromatic agent and desiccant such as Zeolite and active carbon may be contained in the filter units 40 and 41.

Numeral 45 represents a terminal which is connected to a minus terminal located on the side of the power source (not shown).

When the minus electrode 30 is connected to the underside of the adjacent filter unit 41, the former serves as a minus pole, but an independent terminal for use with the minus electrode 30 may be provided. To the contrary, the net 43 for the filter 41 or a part of the conductive frame may be connected to the terminal-attached minus electrode.

When the dust collector unit is to be set in the cabinet A, means for attaching and fixing the dust collector unit is provided on the side or underside of the frame 10, but it may be arranged that the whole of the dust collector unit can be detached from the cabinet A. Or the dust collector unit may be moved so enough as to allow the minus electrode 30 and filter units 40, 41 to be removed outside.

The air cleaner of the present invention having such arrangement as described above enables the above-mentioned objects to be easily achieved. Particularly when the electrodes and filters become dirty, they can be easily cleaned or exchanged with new ones. Therefore, the maintenance of the air cleaner is extremely more advantageous as compared with that of the conventional ones. Further, clean electrodes can usually be used to thereby keep the dust absorption efficiency high.

What is claimed is:

1. An air cleaner comprising:

(A) a cabinet having an air inlet and an air outlet located so as to define a direction of air flow through said cabinet, (B) an operation section mounted on said cabinet, (C) a sensor section mounted on said cabinet and in communication with said operation section, (D) a ventilator mounted in said cabinet and in communication with said operation section, (E) a circuit section mounted in said cabinet in communication with said operation section, (F) a dust collector section being housed within said cabinet and including a filter unit, an electrode section to which a high voltage is applied from said circuit section and having a plus electrode and a minus electrode generally enclosing said plus electrode, and another minus electrode at said filter unit, wherein:

(1) said filter unit has at least one detachable filter positioned adjacent said air outlet;

(2) said electrode section is in appropriate communication with said circuit section and has a frame containing the electrodes of said electrode section; said minus electrode including frame opened at its top and bottom so that air passes through said frame; the plus electrode being supported by a base plate with support rods erected on the base plate upon which the plus electrode is positioned, the plus electrode further being an electrically conductive wire and being positioned within said frame of said electrode section; and at least the minus electrode of said electrode section is detachable from said cabinet, said air cleaner being useful for charging and absorbing dust and other substances from air passing through said cabinet.

2. An air cleaner according to claim 1 wherein the minus electrode of said electrode section is provided with concaved and convexed portions on a vertical side thereof along the direction of air flow.

3. An air cleaner according to claim 2 wherein the minus electrode of said electrode section is a metal plate enclosing the plus electrode and the metal plate has the concaved and convexed portions.

4. An air cleaner according to claim 3 wherein the metal is aluminum.

5. An air cleaner according to claim 1 wherein the minus electrode of said electrode section is a metal plate generally enclosing the plus electrode, and the metal plate has convexed and concaved portions on a vertical side thereof along the direction of air flow.

6. An air cleaner according to claim 1 wherein the minus electrode of said electrode section is a metal plate arranged inside said frame of said electrode section.

7. An air cleaner according to claim 1 wherein the minus electrode of said electrode section is made of synthetic resin and an electrically conductive substance is applied to at least an inner surface of the thus-formed synthetic resin.

8. An air cleaner according to claim 1 wherein the minus electrode of said electrode section is made of conductive synthetic resin, enclosing the plus electrode.

9. An air cleaner according to claim 1 wherein said detachable filter is provided with the other minus electrode.

10. An air cleaner according to claim 1 wherein the plus electrode is detachable from said frame of said electrode section.

11. An air cleaner according to claim 10 wherein the electrically conductive wire of the plus electrode is a tungsten line having a diameter of about 0.3 mm.

* * * * *